United States Patent [19]

Booth

[11] Patent Number: 4,693,622

[45] Date of Patent: Sep. 15, 1987

[54] COMBINED TOOTHBRUSH AND TOOTHPASTE DISPENSER

[76] Inventor: Peter A. Booth, Furtherfields, Chenies Road, Chorley Wood, Hertfordshire, WD3 5LU, United Kingdom

[21] Appl. No.: 807,896

[22] PCT Filed: Mar. 25, 1985

[86] PCT No.: PCT/GB85/00113

§ 371 Date: Nov. 26, 1985

§ 102(e) Date: Nov. 26, 1985

[87] PCT Pub. No.: WO85/04314

PCT Pub. Date: Oct. 10, 1985

[30] Foreign Application Priority Data

Mar. 26, 1984 [GB] United Kingdom ..... 8407759

[51] Int. Cl.[4] ..... A46B 11/02

[52] U.S. Cl. ..... 401/191; 132/84 B; 401/175; 401/277

[58] Field of Search ..... 401/191, 175, 277; 132/84 R, 84 B

[56] References Cited

U.S. PATENT DOCUMENTS

| | | | |
|---|---|---|---|
| 1,235,351 | 7/1917 | McLaughlin | 401/175 X |
| 1,451,941 | 4/1923 | Clum | 401/175 |
| 1,464,250 | 8/1923 | Lieberthal | 132/84 R |
| 1,555,064 | 9/1925 | La Mothe | 401/175 M |
| 1,659,628 | 2/1928 | Greenblatt | 132/84 B |
| 1,769,478 | 7/1930 | Wakeham | 401/175 |
| 2,025,591 | 12/1935 | Folsom-Jones | 132/84 B |
| 2,326,632 | 8/1943 | Friedman . | |
| 2,439,166 | 4/1948 | Hoffman et al. . | |
| 2,498,829 | 2/1950 | Torres | 132/84 B |
| 2,774,981 | 12/1956 | Sous Bonilla . | |
| 2,908,925 | 10/1959 | Reitknecht . | |
| 3,560,103 | 2/1971 | Miranda . | |
| 3,728,035 | 4/1973 | Reitknecht | 401/175 |
| 3,995,648 | 12/1976 | Kuryla | 132/84 B |
| 4,056,110 | 11/1977 | Landsman . | |
| 4,122,983 | 10/1978 | Jolly . | |
| 4,149,552 | 4/1979 | Stewmon | 132/84 B |
| 4,467,822 | 8/1984 | Blackwell | 132/84 B |

FOREIGN PATENT DOCUMENTS

| | | |
|---|---|---|
| 0023407 | 2/1981 | European Pat. Off. . |
| 279994 | 2/1914 | Fed. Rep. of Germany . |
| 706815 | 6/1931 | France . |
| 1073236 | 9/1954 | France . |
| 1227009 | 8/1960 | France . |
| 1569196 | 5/1969 | France . |
| 2198364 | 3/1974 | France . |
| 2400866 | 3/1979 | France . |
| 8303742 | 11/1983 | PCT Int'l Appl. . |
| 280067 | 11/1927 | United Kingdom . |
| 293641 | 7/1928 | United Kingdom . |
| 1325860 | 8/1973 | United Kingdom . |
| 2067396 | 7/1981 | United Kingdom . |

*Primary Examiner*—Steven A. Bratlie

*Attorney, Agent, or Firm*—Biebel, French & Nauman

[57] ABSTRACT

The present invention provides a combined toothbrush and toothpaste dispenser comprising a body casing, also serving as a handle, and a toothbrush member disposed at the proximal end of the body casing and having an arm slidably mounted in the body casing and a brush head. The arm is slidable between a retracted position, in which the brush head is disposed adjacent the body casing, and an extended position. A toothpaste dispenser is housed with the body casing and has a discharge nozzle at the proximal end of the body casing for delivering toothpaste onto the brush when the arm is in its retracted position.

7 Claims, 21 Drawing Figures

COMBINED TOOTHBRUSH AND TOOTHPASTE DISPENSER

BACKGROUND OF THE INVENTION

The present invention relates to a toothbrush and toothpaste dispenser combined as a unit and in which the dispenser is arranged to deliver toothpaste to the toothbrush, and more particularly, to a portable and self-contained tooth cleaning unit designed to be readily carried in the pocket of a user.

Toothpaste dispensers fitted with toothbrushes are well-known. Typical examples of such devices are described in GB-A-2067396, U.S. Pat. No. 3,995,648 and U.S. Pat. No. 4,149,552. In each of these prior devices, the toothpaste dispenser or container constitutes the handle and the toothbrush projects from one end of the container. A passageway extends along the shaft of the toothbrush to deliver paste, dispensed from the container, to the toothbrush head at the back of the bristles. The toothpaste is dispensed by advancing a piston or nut, disposed within the container, along a leadscrew in response to manually turning a knob connected to the leadscrew at the end of the container remote from the toothbrush. A valve may be provided for controlling the flow of toothpaste to the brush and the latter may be arranged to be replaceable.

The known devices are merely directed to providing a supply of toothpaste in combination with a toothbrush and are not concerned with a self-contained tooth cleaning system which may be readily carried in a user's pocket so that the user may conveniently clean his or her teeth at any desired time. They are not foldable, collapsable or otherwise designed to be compact so that they can be conveniently carried.

SUMMARY OF THE INVENTION

Hence, it is an object of the present invention to provide a combined toothbrush and toothpaste dispenser which can be collapsed into a compact unit so that it can be conveniently carried and enables a user to clean his or her teeth when desired, for example, at work or whilst travelling, and when customary tooth cleaning items are not available or not conveniently usable.

To this end, the invention consists in a combined toothbrush and toothpaste dispenser comprising a body casing, also serving as a handle, a toothbrush member disposed at the proximal end of the casing and comprising an arm slidably mounted in the casing and having a brush head at its distal end, said arm being slidable between a retracted position, in which the brush head is disposed adjacent the casing and an extended position, a toothpaste container housed within the casing and having a discharge nozzle at the proximal end of the casing arranged to deliver toothpaste onto the brush when the arm is in its retracted position, and actuating means operable to discharge toothpaste from its container via the nozzle.

Preferably, the toothbrush head is adjustably mounted at the distal end of the arm so that the head can be set in a desired cranked position with respect to the arm, between a position in which the head is aligned with the arm and a position in which the head is substantially perpendicular to the longitudinal axis of the arm. For example, the head may be attached to the arm by means of an articulated connection similarly to that used in the toothbrush described in my prior specification No. EP-A-0023407. The head is preferably set in the position in which it is perpendicular to the arm when the arm is retracted and the unit is not being used, whereupon the free ends of the brush bristles lie adjacent or abut the proximal end of the casing adjacent the discharge nozzle. Hence, when the unit is to be used, operation of the dispenser's actuating means, before extending the toothbrush arm to a desired position, delivers toothpaste to the free ends of the bristles, where it is required, preparatory to cleaning the teeth.

Conveniently, the toothpaste container is slideably fitted within the body casing through the distal end of the casing so as to be readily replaceable when empty. The container may have means disposed within the container for discharging the toothpaste from the nozzle in response to manual operation of an actuating member disposed at or adjacent the distal end of the casing. Conveniently, also, the container is made from translucent material, or at least includes a translucent window, so that its contents can be viewed. For example, a strip-like window may be provided along at least one side of the container and may be arranged to be visible through the casing wall and without removing the container from the casing.

The means for discharging the toothpaste from the container may comprise a screw-type piston or nut mounted on a lead-screw within the container, the leadscrew being rotated to advance the piston or nut by an actuating knob disposed at the distal end of the casing and suitably coupled to the adjacent end of the leadscrew. This knob may be arranged to be removable, upon replacement of the toothpaste container, for refitting to a fresh container. Moreover, it may be arranged to cooperate with indexing means which controls turning of the knob through a predetermined angle to provide for dispensing of a metered quantity of paste from the container. In one preferred embodiment, the toothpaste container is held in position within the body casing by a cap which is engaged with the casing and closes the opening through which the container is fitted into the casing. The leadscrew may have a spindle portion which projects through the cap and is releasably engaged with the actuating knob which is disposed on the outside of the cap. The indexing means may be formed by one or more cooperating detents and recesses on the knob and cap.

The leadscrew may mount a shutter member at its end adjacent the discharge nozzle, this shutter serving as a valve member which closes the nozzle in the indexed position(s) of the actuating knob and opens the nozzle as the knob and leadscrew are rotated between successive indexed positions. This prohibits undesirable leakage of toothpaste from the nozzle.

In the retracted position of the toothbrush arm, a cap may be fitted over the toothbrush head and be engaged with the casing, thereby to protect the head and prevent liquid and paste remaining on the brush from soiling a user's pocket or clothing when the unit is pocketed after use. This cap may be designed with breather holes whilst still preventing leakage of liquid from the cap.

The present invention also consists in a toothbrush device comprising a body casing, also serving as a handle, and a toothbrush member disposed at the proximal end of the casing and comprising an arm slidably mounted in the casing and having a brush head at its distal end, said arm being slidable between a retracted position, in which the brush head is disposed adjacent the casing and an extended position.

Embodiments of the invention in which the toothbrush device is fitted with a protective cap for the toothbrush member have the advantage that they do not require expensive additional packaging for transportation, storage and display purposes. Furthermore, the invention provides a toothbrush device which may be entirely disposable after the toothpaste has been consumed or, alternatively, which may have a disposable toothbrush head and/or toothpaste dispenser which may be replaced when worn out or consumed, as the case may be.

BRIEF DESCRIPTION OF THE DRAWINGS

In order that the present invention may be more readily understood, reference will now be made to the accompanying drawings, in which.

DESCRIPTION OF THE PREFERRED EMBODIMENTS

Figure 1:
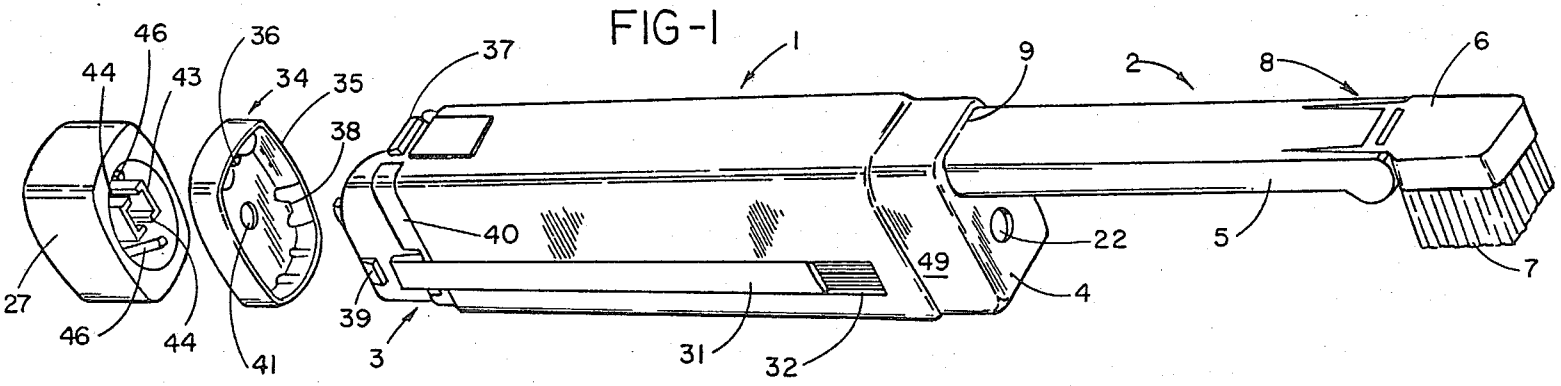
FIG. 1 is a partially exploded perspective view of one embodiment of the invention and showing the toothbrush arm extended.
Figure 2:
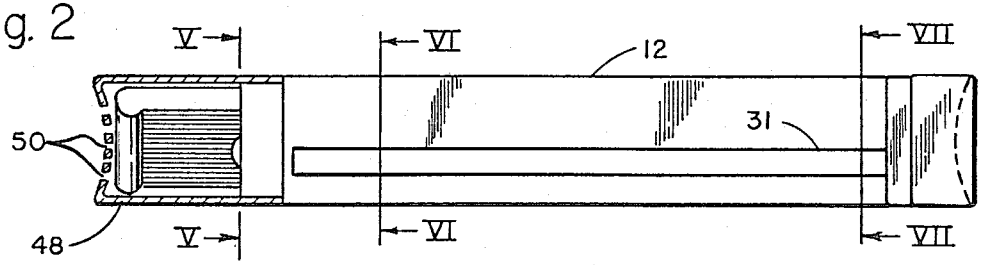
FIG. 2 is an elevational view, partially in section, of the unit illustrated in FIG. 1 and showing the toothbrush in its retracted position and protected by a cap.
Figure 3:
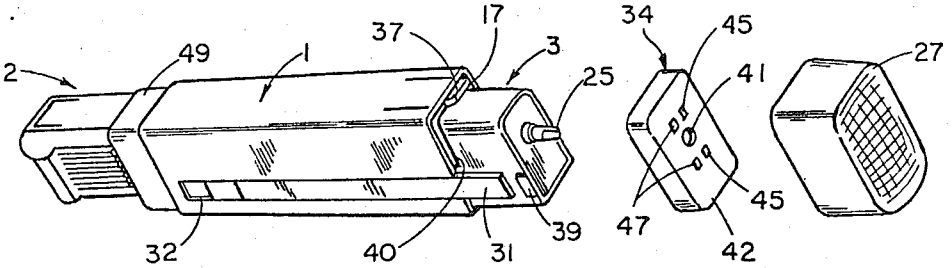
FIG. 3 is an exploded perspective view of the unit taken from the opposite direction to FIG. 1 and with the toothbrush retracted.
Figure 4:
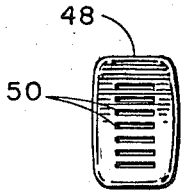
FIG. 4 is an end view of the protective cap.

Referring to FIGS. 1, 2 and 3 of the drawings, the combined toothbrush and toothpaste dispenser unit includes an elongated body casing 1 which is of generally rectangular shape in elevation and cross-section and which may be formed as a plastic molding. The casing supports a toothbrush member 2 and houses a toothpaste dispenser 3. It also serves as the handle of the unit. The toothbrush member 2, which may also be formed from plastic moldings, projects from the proximal end 4 of the casing 1 and comprises an arm 5 slideably mounted in the upper part of the casing and a brush head 6 having bristles 7 and articulated to the distal end of the arm 5. The head 6 is attached to the arm by an articulated connection 8 constructed similarly to that utilized in the toothbrush described in the aforementioned specification No. EP-A-0023407 so that the head can be set in a selected one of a multiplicity of cranked positions with respect to the arm 5, between the position in which the head is aligned with the arm, as shown in FIG. 1, and that in which it is substantially perpendicular to the longitudinal axis of the arm, as shown in FIGS. 2 and 3. This arrangement permits effective brushing and cleaning of all surfaces of the teeth and gums and the spaces between the teeth, and permits the head 6 to be folded into a compact position, in which the bristles 7 abut the end 4 of the casing, when the brush is retracted for carrying purposes.

Other different arrangements of articulated head which are similarly adjustable and are suitable for use in the present invention are illustrated in FIGS. 11 to 20 to be hereinafter more fully described.

Figure 5:
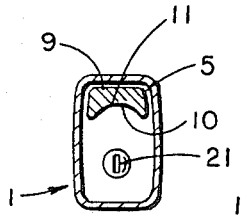
FIG. 5, 6 and 7 are respectively cross-sectional views on the lines V—V, VI—VI and VII—VII of FIG. 2.
Figure 9:
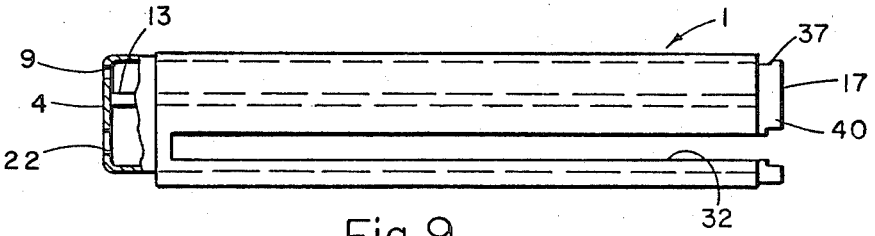
FIG. 9 is an elevational view, partially in section, of the body casing.
Figure 10:
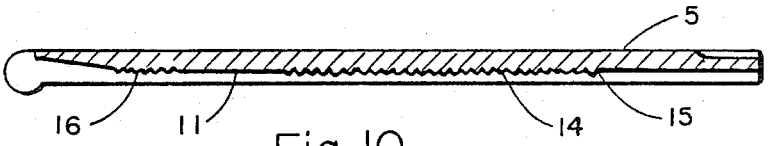
FIG. 10 is a side elevation of the toothbrush arm.
Figure 11:
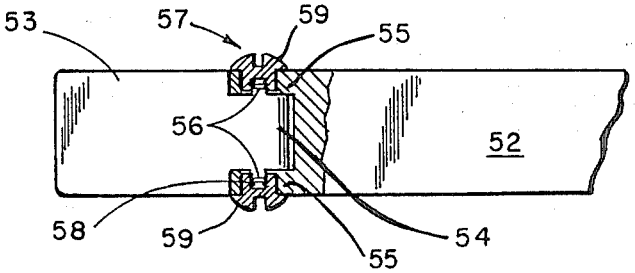
FIGS. 11 to 20 illustrate five different arrangements of articulated connection which may be used between a toothbrush head and the handle or arm of a toothbrush or toothbrush member.
Figure 12:
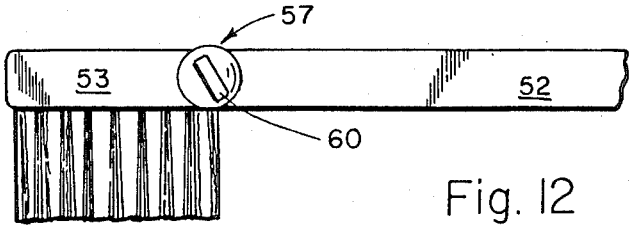

The arm 5 is slideably mounted in the casing through an opening 9 disposed in the top part of the end wall 4. This opening is of generally rectangular shape but has a convex side or tab 10 (FIG. 5) projecting inwardly of the opening along its bottom side and cooperating with a complementary concave bottom side 11 (FIGS. 5 and 10) of the arm 5. Within the casing, the arm 5 is supported between the casing top 12 and small ribs or shoulders 13 formed internally on the side walls of the casing (see FIGS. 7 and 9). The tab portion 10 of the opening serves as a pawl which cooperates with ratchet teeth 14 formed on the underside of the arm so that the arm may be set in a selected one of a multiplicity of different extended positions between its fully retracted and fully extended positions. A stop 15 at the inner end of the series of ratchet teeth 14 is engageable with the tab 10 to prevent the arm from being pulled from the casing. A short series of ratchet teeth 16 adjacent the outer end of the arm 5 engage with the tab 10 in the retracted position of the arm to retain the latter in that position, when the brush is not in use.

Figure 6:
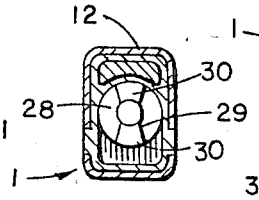
Figure 7:
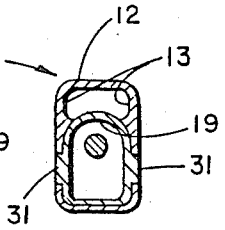
Figure 8:
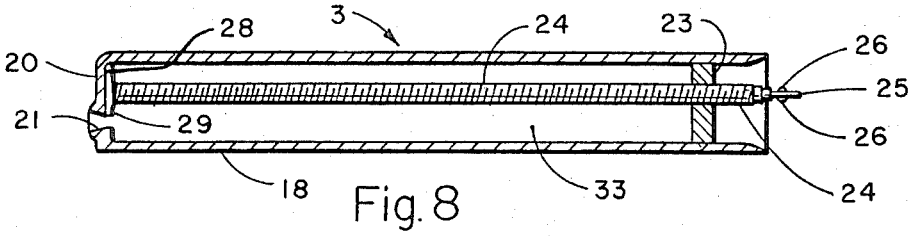
FIG. 8 is a longitudinal sectional view through the toothpaste dispenser.

The toothpaste dispenser 3 is slideable into a bottom portion of the body casing 1 through the open, distal end 17 of the latter. Referring particularly to FIGS. 6, 7 and 8, it comprises a tubular container 18 of generally rectangular shape in cross-section but having an arcuate upper wall portion 19 cooperating with the concave underside 11 of the arm 5. The inner or proximal end wall 20 of the container has a discharge nozzle 21 which projects into a suitable opening 22 (FIG. 1) in the proximal end wall of the body casing, when the dispenser is fully inserted into the latter, for delivering toothpaste to the toothbrush bristles 7. The outer end wall of the container is formed by a screw-type piston or nut 23 of complementary shape to the internal section of the container and mounted on a leadscrew 24 extending longitudinally of the container. At its outer end, the leadscrew has a spindle portion 25 which is of rectangular section and is formed with small ears 26, whereby to enable the leadscrew to be coupled to an actuating knob 27, as will be hereinafter more fully described. At its inner end, the leadscrew 24 is journalled in a circular recess 28 in the end wall 20 of the container by a shutter member 29 comprising two diametrically opposite sector portions 30. The lower portion of the circular recess 28 overlies the inner end of the discharge nozzle 21 so that the latter is closable by the shutter sectors 30 to prevent undesirable leakage of toothpaste from the container.

The container 18, which may be a plastic molding, is made from transparent material and has strip-like ribs 31 extending substantially along the full length of opposite sides of the container and engaging in complementary slots 32 in the side walls of the body casing 1. These strip-like ribs serve as windows through which the contents of the container, held within the container chamber 33, can be viewed to check the quantity remaining and enable replacement of the dispenser by a fresh dispenser at the appropriate time.

The dispenser 3 is retained within the casing 1 by a cap 34 which closes the open distal end 17 of the casing. On its inside, the cap skirt 35 is formed with a top detent 36, which engages with a resilient catch 37 formed at the rear of the top of the casing, and side detents 38, which engage catch members 39 formed on opposite sides of the container. When a dispenser is loaded into the casing and the cap is applied, it snaps into engagement with the catches 37, 39 to retain the dispenser in position. The cap skirt 35 also engages with a rebate 40 at the distal end of the casing. When the dispenser is to be replaced, a pull on the cap 34 releases it from the casing catch 37 and, by reason of the catches 39 engaging the cap, the dispenser is withdrawn with the cap to facilitate its replacement. Once the dispenser has been withdrawn, it is a simple matter to snap the cap free of the dispenser for use with a fresh dispenser. When a dispenser 3 is positioned within the casing 1, its leadscrew 29 is disposed centrally of the casing section.

The leadscrew spindle 25 projects through an aperture 41 in the top 42 of the cap for engagement with the hollow actuating knob 27 disposed on the outside of the cap. The knob has a central sleeve 43 (FIG. 1) which engages with the leadscrew spindle. This sleeve has diametrically opposed slots 44 which engage with the diametrical opposite ears 26 of the spindle so as to facilitate turning of the leadscrew. Also, the ears 26 are aligned with the shutter sectors 30 of the shutter device 29 so that, when the ears are vertical and the knob is aligned with the casing, one of the shutter sectors 30 closes the discharge nozzle 21 of the container. The cap top has indexing grooves 45 formed at diametrically opposite positions on its outside for cooperating with indexing fingers 46 on the knob. These members index the knob in its aligned position and permit dispensing of metered quantities of toothpaste and prevent accidental turning of the knob when the unit is not being used. The indexing grooves 45 may be defined by ribs or bosses 47 formed on the cap top, the outside edge of the appropriate ribs 47 being provided with lead-in tapers (not shown) so as to facilitate snapping of the index fingers into engagement with the grooves upon completion of each half-turn of the knob.

When the toothbrush is in its retracted position, as shown in FIGS. 2 and 3, the toothbrush may be protected by a cap 48 which is a frictional fit about a rebate 49 formed at the proximal end of the body casing. This protective cap 48 prevents the toothbrush from being soiled and becoming unhygienic whilst it is being carried, for example, in person's pocket, and it also prevents toothpaste and liquid on the brush from soiling the person's clothing. The cap 48 has breather holes 50 in its closed end which is of concave shape, thereby reducing the risk of any liquid retained in the cap from leaking through the breather holes.

The caps 34 and 48 and the knob 27 may be formed as plastic moldings.

As will be apparent from FIG. 2, the invention provides a very compact toothbrush and toothpaste dispenser unit which can be carried in a person's pocket for use at any desired time. When it is to be used, the protective cap 48 is removed and, with the toothbrush member 2 cap 48 is removed and, with the toothbrush member 2 still retracted and the head 6 folded at right angles to the arm 5, as shown in FIG. 2, the actuating knob 27 is turned to dispense toothpaste, via the discharge nozzle 21, to the adjacent free ends of the brush bristles 7. The knob is turned through a whole number of half turns to dispense the required amount of toothpaste, the knob being indexed in the position in which it is aligned with the casing 1 at the end of each half-turn by engagement of the indexing fingers and grooves 45,46. Each half-turn dispenses a metered quantity of toothpaste and, also, at the end of each half-turn the nozzle 21 is closed by one of the shutter sectors 30 of the shutter to prevent leakage of paste. Having dispensed the required quantity of toothpaste onto the brush, the arm 5 is pulled from the casing to a desired extended position and, with the head 6 straightened, or in a more or less cranked position, as required, and using the body casing 1 as a handle, the teeth may be cleaned. At the end of the cleaning operation, the brush is returned to the position shown in FIG. 2 and the protective cap 48 is applied in readiness for returning the unit to a pocket or other storage place. The quantity of toothpaste remaining in the dispenser may be readily checked via the windows 31, without removing the dispenser from the body casing, and it is a simple matter to replace the dispense when it is empty.

Different arrangements by which the head of a toothbrush may be articulated to an arm or handle either for the purposes of the toothbrush member 2 utilized in the present invention or for other toothbrush constructions are illustrated in FIGS. 11 to 20. Hence, in the arrangement shown in FIGS. 11 and 12, the end of the toothbrush handle 52 adjacent the toothbrush head 53 is bifurcated and an adjacent end portion 54 of the head projects into the bifurcated end of the handle and is articulated to the semi-circular ears 55, formed by the bifurcation, by means of a pair of threaded trunnions 56 on the head and cooperating cap nuts 57. The ears 55 have aligned apertures 58 and the trunnions 56 project into these apertures and engage with the cap nuts 57 journalled in the apertures 58 and screwed onto the trunnions from the outside of the ears 55. The cap nuts are formed with heads 59 having screwdriver slots 60. The toothbrush head 53 may be turned to a required position relative to the handle 52 to provide for proper brushing and cleaning of the teeth and gums and is set in the selected position by tightening the cap nuts 57, thereby frictionally clamping the end portion 54 of the head between the ears 55 of the handle. The cap nuts may be readily turned to release or tighten the clamping action and permit adjustment of the head by turning a cap nut with the aid of a fingernail inserted into the screwdriver slot 60. The tightness of the nuts may be regulated by a user so that, in the event of the application of excessive brushing pressure, the head can turn to relieve the excess pressure.

Figure 13:
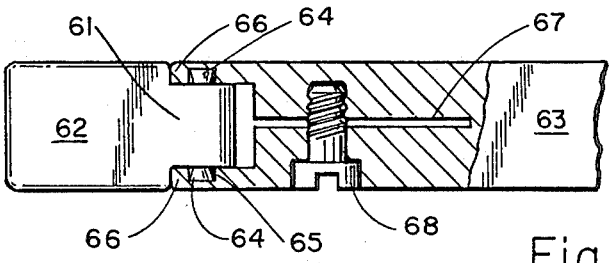

In FIG. 13, the projecting end portion 61 of the toothbrush head 62 is articulated to the adjacent bifurcated end of the handle 63 by means of a pair of trunnions 64 journalled in cooperating holes 65 on the insides of the arms 66 of the bifurcation and, rearwardly of the bifurcation, the handle is formed with a longitudinal slot 67 which is opened and closed under the control of a screw 68 threaded transversely into the handle part and across the slot. The head 62 is retained in a selected position with respect to the handle by tightening the screw 68 which closes the slot 67 and tends to draw the arms 66 together to exert a clamping action on the end portion 61 of the head. The screw 68 may be turned with a fingernail, when adjustment is required, and radial arrays of cooperating ribs and grooves (not shown) may be formed on the end portion 61 and on the insides of one or both of the arms 66 about the trunnions 64 and holes 65, respectively, in order to provide for more positive locking of the head in a selected position relatively to the handle. Similarly to the previous arrangement, the tightness of the screw 68 may be regulated so that the brush head can turn, if excessive brushing pressure is applied, in order to relieve the excess pressure.

Figure 14:
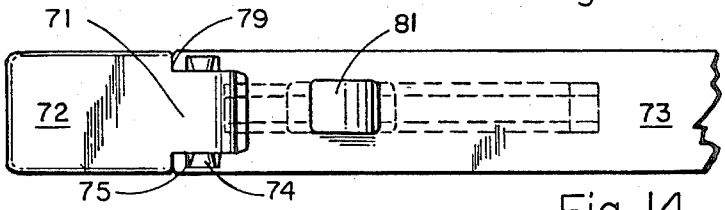
Figure 15:
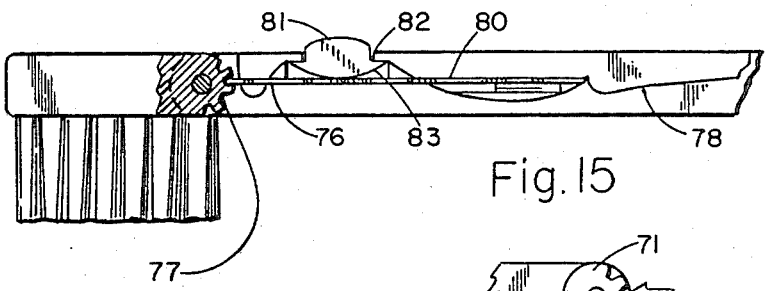
Figure 16:
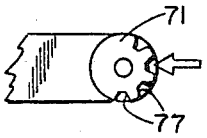

In FIGS. 14 and 15, the projecting end portion 71 of the toothbrush head 72 is articuated to the adjacent bifurcated end of the handle 73 by cooperating trunnions 74 and holes 75 on the two parts, and the position of the head relatively to the handle is controlled by a leaf spring 76 engaging in a selected one of a series of axial grooves or notches 77 in the adjacent semi-circular end face of the head. The leaf spring 76 is mounted in a longitudinal cavity 78 formed in the underside of the handle 73 and opening into the gap between the arms 79 of the bifurcated end of the handle. It is mounted in the cavity 78 by having its rear end portion fastened in a slot 80 in the cavity and it projects forwardly from the slot in cantilever fashion and has its opposite end engaged in one of the cooperating grooves 77 in the adjacent end of the head. The cantilevered portion of the spring 76 can be deflected by a small press button 81 mounted in an opening 82 in the top of the handle 73 and arranged to bear on the upper surface of the spring. The button is retained in the opening 82 by the spring and flanges 83 formed about its periphery and engaging the underside of the handle about the opening. In order to adjust the head relatively to the handle, the button 81 is depressed to disengage the end of the spring 76 from the cooperating groove 77, whereupon the head can be turned to another one of the predetermined positions defined by the grooves and is latched in that position by releasing the button and allowing the end of the spring to engage in the selected groove. By forming the grooves 77 with diverging side walls, as shown in the fragmentary view of FIG. 16, the articulated connection is provided with a pressure release characteristic. That is, in the event of the application of excessive cleaning pressure, as determined by the leaf spring resisting relative turning movement between the head and the handle, the spring will automatically disengage from the selected groove and allow the head to turn so as to relieve the excess pressure.

Figure 17:
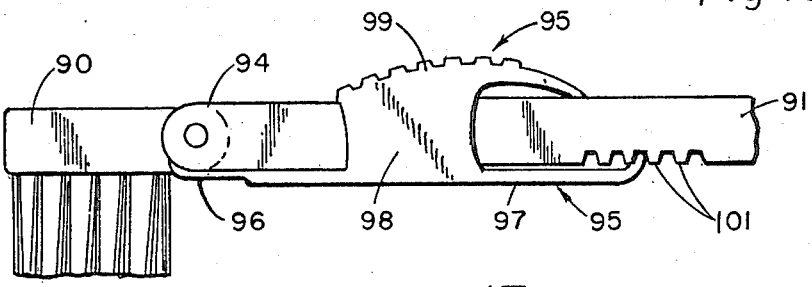
Figure 18:
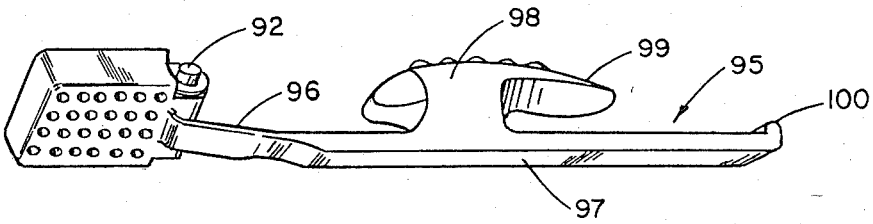

In FIG. 17 and 18, the head 90 is artuculated to the adjacent end of the handle 91 by trunnions 92 engaging in cooperating holes in the inside surfaces of the arms 94 of the adjacent bifurcated end of the handle, similarly to the arrangement of FIGS. 14 and 15, and its position relative to the handle is controlled by a slider device 95. This slider device is formed integrally with the head and is connected thereto by a thin flexible web 96 which joins the underneath of the head forwardly of the trunnion axis. It comprises a latching bar 97 intergral with the web 96, a sleeve portion 98 projecting above the latching bar and a resilient actuator portion 99 at the top of the sleeve portion. At its end remote from the head, the latching bar has a detent 100. When the head is assembled to the handle, the sleeve part 98 is slidably engaged over the handle with the latching bar disposed underneath the handle and with the detent 100 arranged to engage in a selected one of a series of transverse grooves 101 formed in the underside of the handle. The web 96 is also positioned on the underside of the handle and the actuator 99 is disposed on the top of the handle and bears against the handle top. The actuator is of generally concave configuration and its inherent resiliency tends to urge the latching bar upwardly against the underside of the handle and urges the detent 100 into one of the cooperating grooves 101. Finger pressure on the actuator 99 disengages the detent 100 of the latching bar from its engaged groove 101 and enables the device 95 to be slid backwards and forwards along the handle in order to turn the head 90, via the web 96, into a selected one of the several positions defined by the grooves 101. As with the previous arrangement, a pressure release characteristic may be provided by inclining the sides of each groove 101 so that they diverge outwardly.

Figure 19:
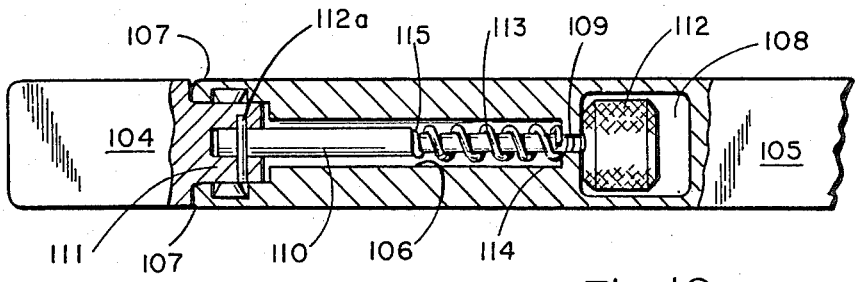
Figure 20:
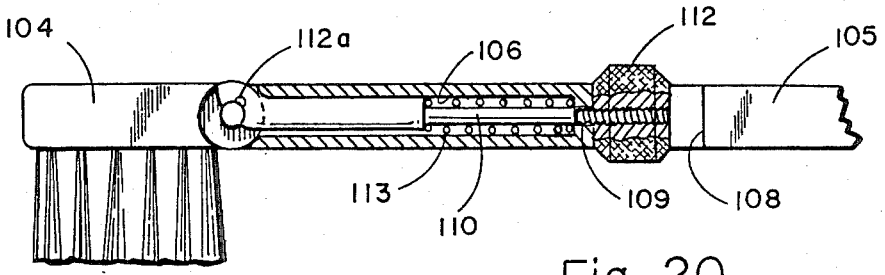

The arrangement shown in FIGS. 19 and 20 has a head 104 pivoted to the adjacent bifurcated end of the handle 105 in a similar manner to the arrangement of FIGS. 17 and 18 and, rearwardly of its bifurcated end, the handle is formed with an axial passageway 106, one end of which opens into the gap between the arms 107 of the bifurcation and the opposite end of which is connected to an opening 108 in the handle via a smaller diameter axial passageway 109. Disposed in the bore is a rod 110 having one end pivotally connected to a clevis 111, formed in the adjacent end portion of the head, by means of a pivot pin **112*a* which is located in an eccentric position with respect to the pivot or trunnion axis of the head. The opposite end of the rod projects through the smaller passageway 109 and its projecting end is threaded and engages with a knurled nut 112 located in the handle opening 108. A compression spring 113 is arranged on the rod between shoulders 114, 115 at the end of the passageway 106 and on the rod, respectively. This spring resiliently urges the nut against the adjacent end of the passageway 109 and tends to urge the head 104 in an anti-clockwise direction about its pivot axis, as viewed in FIG. 20. Hence, upon unscrewing of the nut 112, the head 104 can move about its pivot axis, in an anti-clockwise direction, to a selected position, whilst tightening of the nut adjusts the head in the opposite direction. The knurled nut 112 may be readily turned, by a user, with the thumb. In the event of the application of an excessive brushing pressure, as determined by the resistance of the spring 113**, the latter enables the head to turn clockwise relatively to the handle to relieve such pressure.

Save for the springs 76, 113, the parts of the different articulated head constructions described above may be formed as plastic molding.

Figure 21:
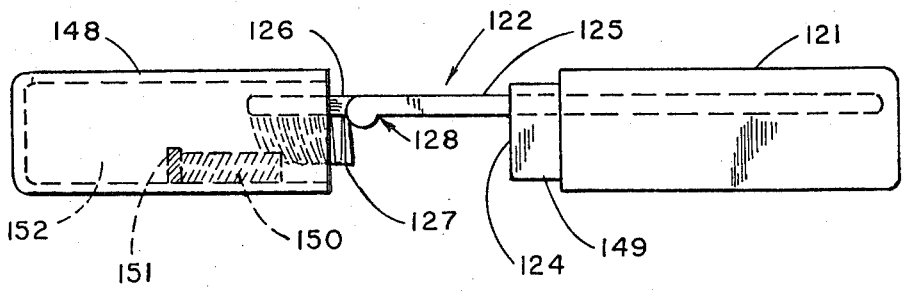
FIG. 21 is a side elevation of another embodiment of the invention and showing the cap of this tooth cleaning unit partially removed.

FIG. 21 illustrates another embodiment of tooth cleaning unit according to the invention. This unit includes an elongated body casing 121 which is of generally similar external shape to the casing 1 of the embodiment shown in FIGS. 1 to 10. However, in the embodiment of FIG. 21, the casing 121 serves solely as a support and hollow handle for an extendible toothbrush member 122. The latter projects from the proximal end 124 of the casing and comprises an arm 125 slidably mounted in the upper part of the casing and a brush head 126 having bristles 127 and articulated to the distal end of the arm 125. The slidable mounting of the arm 125 within the casing 121 may be achieved in a similar manner to the embodiment of FIGS. 1 to 10, whilst the articulated connection 128 between the head and the arm may be of any of the constructions hereinbefore described, whereby it can be set in a selected one of a multiplicity of cranked positions with respect to the arm 125, between the position in which the head is aligned with the arm, as shown in FIG. 21, and that in which it is projecting downwardly substantially perpendicular to the arm.

When the toothbrush is in its retracted position, as shown in FIG. 21, the brush head 126 is somewhat spaced from the proximal end 124 of the casing 121 and is arranged to be protected by a cap 148 which is a frictional fit on a rebate 149 formed at the proximal end of the body casing. This protective cap 148 also serves as a holder for a cake 150 of a solid tooth cleaning composition, such as that marketed under the trade name DENTRIFRICE. The cake of cleaning composition is retained in a small receptacle 151 which may be molded integrally with the bottom wall of the cap skirt adjacent the open end of the cap or, alternatively, may be formed as a separate receptacle which is removably secured within the cap so that it can be readily replaced with a receptacle containing fresh compound when the original supply has been used-up. In either case, the arrangement is such that there is a space 152 between the receptacle 151 and the cap top for accommodating the bristles 127 of the brush head in an unflexed state when the cap is fully fitted onto the body casing 121. As the cap is fitted onto the casing and removed therefrom, the free ends of the bristles 127 are flexed into contact with the tooth cleaning composition 150 so that composition may be automatically applied to the free ends of the bristles preparatory to brushing the teeth. Also, it is a relatively simple matter positively to rub the bristles in contact with the composition to apply additional material thereto, after the cap has been removed.

Similarly, to the preceding embodiments, the components of tooth cleaning unit of FIG. 21 may be formed as plastic moldings.

Whilst particular embodiments have been described, it will be understood that modifications can be made without departing from the scope of the invention as defined by the appended claims. For example, whilst the combined toothbrush and toothpaste dispenser described with reference to FIGS. 1 to 10 has a separate interchangeable toothpaste dispenser 3, it will be appreciated that the invention is equally applicable to a combined toothbrush and toothpaste dispensing unit in which the toothpaste container is formed as an integral part of the body casing. In another embodiment, the interchangeable toothpaste dispenser 3 may be an aerosol container, the arrangement being such that a slight pressure on the toothbrush member 2, when in its retracted position, dispenses a required amount of toothpaste onto the folded brush head 6.

In a modification of the embodiment shown in FIG. 21, the arm 125 of the toothbrush member 122 is constructed as a fixed arm instead of an extendible one and is made of a convenient length for enabling a user to brush his teeth. The cap 148 is made of a sufficient length to accommodate the fixed length of the arm and head 125,126 and incorporates a receptacle 151 of tooth cleaning composition similarly positioned to that shown in FIG. 21 to provide for automatic application of composition to the toothbrush bristles 127 as the cap is fitted onto and removed from the hollow casing 121.

I claim:

1. A combined toothbrush and toothpaste dispenser which is characterised by being collapsible into a compact unit for convenient carriage by a user, comprising.

an elongated body casing which also serves as handle means and which is defined by proximal and distal ends having elongated side wall means extending therebetween, said proximal end including proximal end wall means, a toothbrush member located at said proximal end of said body casing and including arm means mounted in said body casing and a brush head supported at the distal end of said arm means and having bristles projecting generally perpendicularly from said brush head, means slidably mounting said arm means adjacent said side wall means of said body casing for relative longitudinal movement substantially parallel to said side wall means between a retracted position in which said brush head is disposed adjacent and externally of said proximal end wall means of said body casing and an adjustable extended position, articulating means adjustably supporting said brush head from said distal end of said arm means, whereby said brush head is movable between a first position in which said brush head is aligned with said arm means and a second position in which said brush head is substantially perpendicular to said arm means, said articulating means including means for resisting movement of said brush head, and said brush head generally lying within the boundaries of said proximal end wall means when located in said second position of said brush head, toothpaste dispensing means disposed within said body casing and including discharge nozzle means extending through said proximal end wall means of said body casing, discharge means operable to discharge toothpaste from said dispensing means via said discharge nozzle means, said brush head being settable in said second position thereof when said arm means is in said retracted position, whereby said bristles of said brush head are directed towards and overlie said discharge nozzle means for receiving toothpaste therefrom in response to operation of said discharge means, manual actuating means for controlling operation of said discharge nozzle means, indexing means associated with said manual actuating means for defining at least one indexed position of said manual actuating means, whereby to provide for dispensing of a metered quantity of toothpaste in response to operation of said discharge nozzle means by said manual actuating means, and valve means which is adapted to operate in response to operation of said discharge nozzle means by said manual actuating means and which closes said discharge nozzle means in said at least one indexed position of said manual actuating means and opens said discharge nozzle means between successive indexed positions.

2. The combination of claim 1 and further comprising a cap fitting over said brush head and engageable with said body casing when said arm means is in said retracted position and said brush head is in said second position thereof, whereby to protect said brush head and prevent liquid and paste remmining thereon from soiling external items.

3. The combination of claim 1 wherein said toothpaste dispensing means includes a toothpaste container housed within said body casing and having said discharge nozzle means formed thereon in a position to project through said proximal end wall means of said body casing, and wherein said toothpaste container is slidably fitted within said body casing through said distal end of said body casing so as to be readily replaceable when empty, and said discharge nozzle means is disposed within said container for discharging toothpaste from said discharge nozzle means in response to operation of said manual actuating means which is disposed at said distal end of said body casing.

4. The combination of claim 3 wherein said toothpaste container includes at least a portion made from translucent material, whereby the quantity of its contents can be viewed.

5. The combination of claim 3 wherein said discharge nozzle means comprises a screw-type piston or nut mounted on a leadscrew within said toothpaste container, said leadscrew being rotatable to advance said piston or nut by manual actuating means in advance said piston or nut by manual actuating means in the form of an actuating knob disposed at said distal end of said body casing and suitably coupled to an adjacent end of said leadscrew.

6. The combination of claim 5 wherein said indexing means is adapted to control turning of said actutating knob through a predetermined angle to provide for dispensing of said metered quantity of toothpaste form said dispensing means, wherein said toothpaste container is held in position within said body casing by a cap which is engaged with said body casing and closes the opening in said distal end of said body casing through which said toothpaste container is fitted into said body casing, and said leadscrew has a spindle portion which projects through said cap and is releasably engaged with said actuating knob which is disposed on the outside of said cap.

7. The combination of claim 6 wherein said valve means comprises shutter means mounted on an end of said leadscrew adjacent said discharge nozzle means and turnable with said leadscrew to close said discharge nozzle means in said at least one indexed position of said actuating knob and open said discharge nozzle means as said actuating knob and leadscrew are rotated between successive indexed positions.

* * * * *